United States Patent [19]

Kasper

[11] Patent Number: 5,022,115

[45] Date of Patent: Jun. 11, 1991

[54] INTAKE NOZZLE ASSEMBLY FOR A LIQUID BATH VACUUM CLEANER

[75] Inventor: Gary A. Kasper, Cadillac, Mich.

[73] Assignee: Rexair, Inc., Cadillac, Mich.

[21] Appl. No.: 467,746

[22] Filed: Jan. 19, 1990

[51] Int. Cl.[5] ..... A47L 9/18

[52] U.S. Cl. ..... 15/353; 55/248; 55/253

[58] Field of Search ..... 15/353; 55/244, 248, 55/250, 253

[56] References Cited

U.S. PATENT DOCUMENTS

| | | | |
|---|---|---|---|
| 2,184,731 | 12/1939 | Brewer | 55/250 X |
| 2,221,572 | 11/1940 | Brock et al. | 55/248 |
| 2,233,167 | 2/1941 | Holm-Hansen | 55/250 X |
| 2,673,619 | 3/1954 | Martin | 55/253 |
| 2,945,553 | 7/1960 | Brock | 55/248 |
| 2,954,095 | 9/1960 | Brock | 55/255 X |
| 4,547,206 | 10/1985 | Sovis et al. | 15/353 X |
| 4,693,734 | 9/1987 | Erickson | 55/248 |

*Primary Examiner*—Chris K. Moore

*Attorney, Agent, or Firm*—Harness, Dickey & Pierce

[57] ABSTRACT

A vacuum cleaner system having an intake nozzle integrally formed with a concave lower portion of a vacuum canister assembly of the vacuum cleaner system. The intake nozzle protrudes downwardly and communicates with an opening in a convex upper surface of a liquid pan removably attached to the concave lower portion of the vacuum canister assembly. Attaching the intake nozzle with the concave lower portion of the vacuum canister assembly allows the interior area of the liquid pan to be more easily cleaned. In a preferred embodiment of the invention a gasket is interposed between the concave lower portion of the vacuum canister assembly and the convex upper surface of the liquid pan to help provide a relatively air-tight seal between the main vacuum canister and the liquid pan.

9 Claims, 2 Drawing Sheets

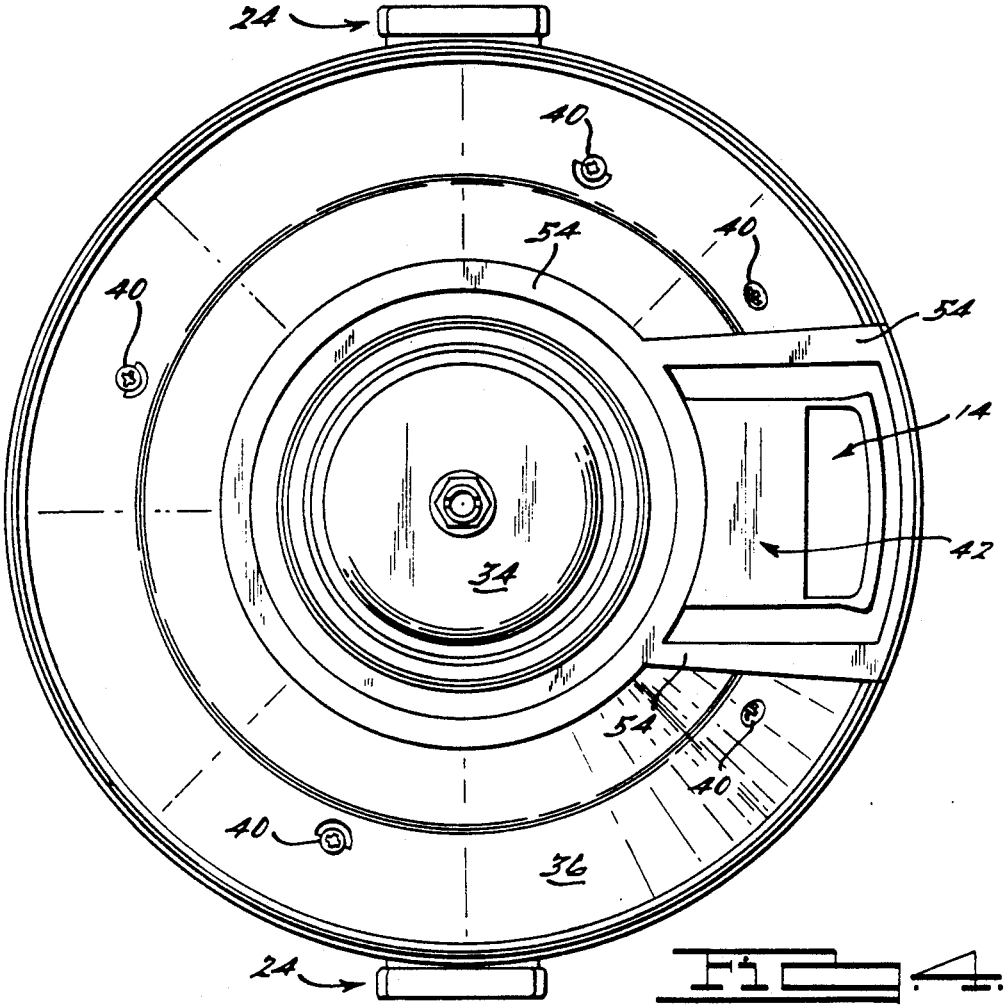
FIG. 4.
FIG. 2.
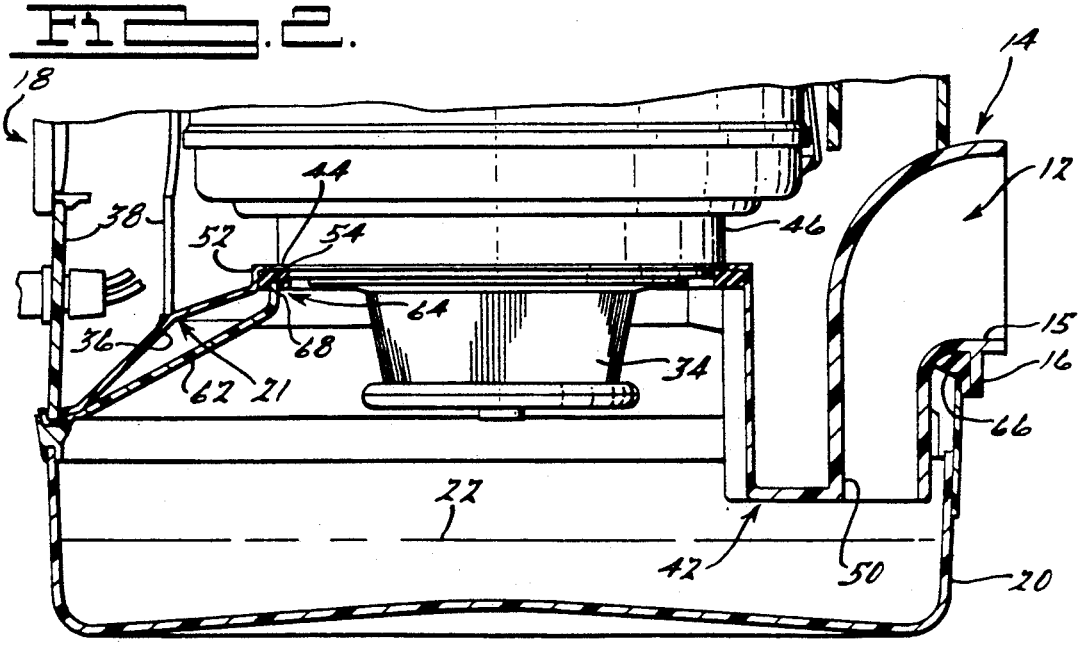

INTAKE NOZZLE ASSEMBLY FOR A LIQUID BATH VACUUM CLEANER

BACKGROUND OF THE INVENTION

1. Technical Field

This invention relates to liquid bath vacuum cleaner systems and, more particularly, to a removable, liquid pan assembly for use with a liquid bath vacuum cleaner.

2. Discussion

Liquid bath vacuum cleaners are used in a wide variety of residential and industrial applications. These vacuum cleaners typically include a main vacuum canister with a removably attached liquid pan. An intake nozzle of the pan matingly engages with an opening in the canister when the pan is attached to the canister to allow dust and dirt entrained air to be ingested by a vacuum force through the intake nozzle into the area defined by the liquid pan. The pan is removed periodically from the main vacuum canister and flushed out with water or another cleaning solution as it is articulated into various positions.

Although liquid pan and canister combinations as described above operate well to receive and trap dust and dirt particles entrained in ingested air, the attached intake nozzle tends to impede cleaning by trapping dirt when flushing out the pan.

It is therefore a principal object of the present invention to provide a liquid pan for a liquid bath vacuum cleaner which may be more easily cleaned than conventional pans from liquid bath vacuum cleaners.

It is a further object of the present invention to provide a main vacuum canister having an attached intake nozzle operable to receive dust and dirt entrained air ingested by the vacuum cleaner and to direct the ingested air towards a removably attachable liquid bath pan.

It is still a further object of the present invention to provide a removable liquid pan having an opening operable to communicate with an intake nozzle of a main vacuum canister to thereby allow airflow through the nozzle and the opening into an interior area of the liquid pan.

SUMMARY OF THE INVENTION

The above and other objects are provided by a liquid bath vacuum cleaner system having an intake nozzle assembly in accordance with the present invention. In a preferred embodiment, the vacuum cleaner system generally includes a main vacuum canister, an intake nozzle and a removable pan. The main vacuum canister has a lower surface from which the intake nozzle protrudes outwardly. The intake nozzle enables debris to be intaked into the pan.

The pan is removably connected to the lower surface of the main vacuum canister and includes an upper surface having an opening in communication with the intake nozzle. By incorporationg the intake nozzle with the main vacuum canister rather than with the pan, the ease with which the pan may be periodically cleaned is improved and a greater variation in design may be accomplished, as well as ease in manufacture. More specifically, the pan may be articulated into various positions and dirt and debris contained therein may be flushed out more easily than if the intake nozzle were incorporated with the pan.

BRIEF DESCRIPTION OF THE DRAWINGS

The various advantages of the present invention will become apparent to one skilled in the art by reading the following specification and subjoined claims and by referencing the following drawings, in which:

FIG. 2 is a fragmentary view of the system showing the intake nozzle assembly and the liquid pan in cross-section;

FIG. 4 is a view of the lower surface of the main vacuum canister taken along section lines 4—4 of FIG. 1.

DETAILED DESCRIPTION OF THE PREFERRED EMBODIMENTS

Figure 1:
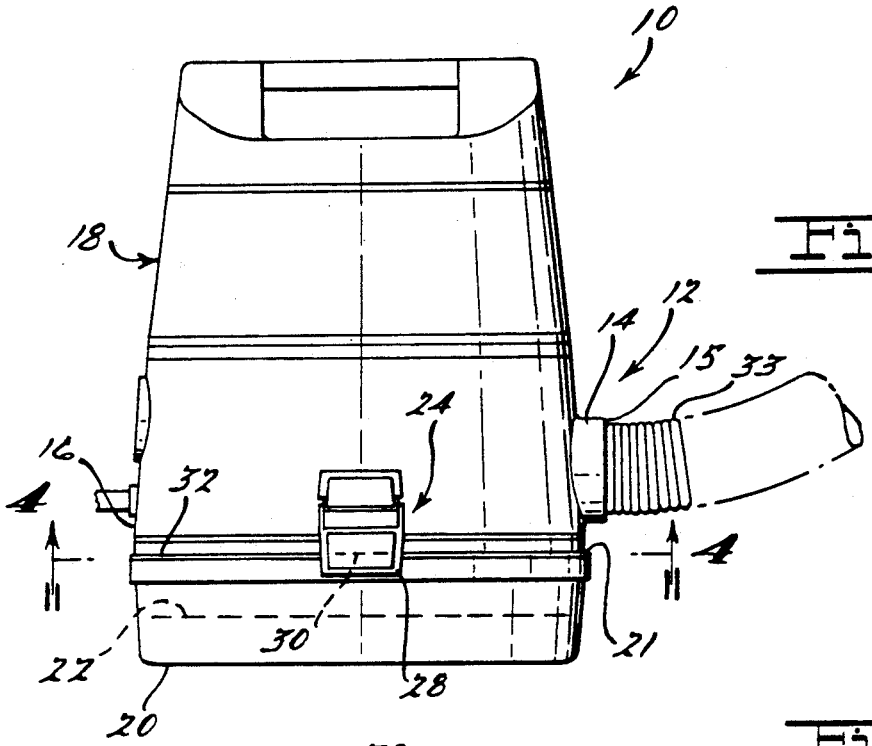
FIG. 1 is a side elevational view of a vacuum cleaner system incorporating the intake nozzle assembly of the present invention.

In FIG. 1 a vacuum cleaner system 10 incorporating an intake nozzle assembly 12 in accordance with the present invention is shown. The intake nozzle assembly 12 generally includes an intake nozzle 14 integrally formed with or otherwise attached to a generally cylindrical, lower side portion lower 16 of a main vacuum canister 18 to thereby form an intake port 15. A preferably cylindrically-shaped liquid pan 20 is removably connected to a lower surface 21 of the main vacuum canister 18 and holds a liquid filtering agent 22 such as water. The intake nozzle 14 and pan 20 are both preferably formed of a rigid plastic by injection molding. Latches 24, of which only one can be seen in FIG. 1, allow the liquid pan 20 to be removably attached to lower surface 21 (shown more clearly in FIG. 4) of the main vacuum canister 18. The latches 24, which are well known in the art, are spring biased to allow a lower portion 28 of each latch to abuttingly engage with shoulder portions 30 (of which only one is shown by a hidden dashed line) protruding from opposing sides of an upper edge 32 of the liquid pan 20.

In operation, dust and dirt entrained air is ingested in by the system 10 via a removable vacuum hose 33 coupled to the intake port 15 and the intake nozzle 14. The air is then directed downwardly into the liquid pan 20. The ingested air impinges the liquid filtering agent 22 in the pan 20 and the inner walls of the pan 20. The inner walls of the pan 20 will typically be wet from the slight sloshing and agitation of the water 22, which is created by the vacuum force of the system 10. The liquid 22 operates to trap dust and dirt particles entrained in the ingested air before the air is expelled from the system 10.

Referrign now to FIG. 2, the intake nozzle 14 and liquid pan 20 are shown in assembly relation in greater detail. A separator 34 is also shown and is adatpted to partially reside within the pan 20. The lower surface 21 of the main vacuum canister 18 includes a lower cover 36, preferably concave in shape, secured to lower frame portions 38 of the main vacuum canister 18 by screws 40 (shown in FIG. 4). The lower cover 36 includes a downwardly protruding shoulder portion 42, preferably integrally formed with the lower cover 36 adjacent the intake nozzle 14, for helping to keep the dirt-entrained, ingested air in close proximity with the liquid filtering agent 22. This enhances the ability of the filtering agent 22 to trap the dirt particles therein.

The lower cover 36 also includes an annular sealing ring 44 concentrically disposed within the main vacuum canister 18 and secured to a lower portion of a fan housing 46 by screws (not shown). Integrally formed with the lower cover 36 is the intake nozzle 14 which protrudes downwardly in a curved fashion from the lower side portion 16 of the main vacuum canister 18. A lower most tubular end portion 50 of the intake nozzle 14 protrudes downwardly from the lower cover 36 and is adapted to reside partially within the liquid pan 20 when the pan 20 is attached to the main vacuum canister 18.

From FIG. 2 it can also be seen that the lower cover 36 includes a shoulder portion 52 which is adapted to abut an annular gasket 54. The gasket 54 is secured, preferably by an adhesive, to the annular sealing ring 44 and a portion of the lower cover 36. The gasket 54 is shaped so as to circumscribe the separator 34 and the downwardly lowermost tubular end protruding, portion 50 of the intake nozzle 14 (shown more clearly in FIG. 4). An adhesive that works particularly well in securing the gasket 54 is available from the 3M Corporation under Product No. 1022.

With further reference to FIG. 2, it can be seen that the liquid pan 20 includes an upper convex surface 62 having a concentrically disposed annular opening 64 (shown more clearly in FIG. 3) for receiving the separator 34, and a slot-like opening 66 for receiving a portion of most tubular end the lower portion 50 of the intake nozzle 14. The upper convex surface 62 further includes an upwardly protruding shoulder portion 68 which circumscribes the area defined by the annular opening 64 and the slot-like opening 66. The shoulder portion 68 is adapted to forcibly abut the gasket 54 to thereby form a relatively air-tight seal between the upper convex surface 62 and the lower cover 36 when the liquid pan 20 is attached to the main vacuum canister 18.

When the liquid pan 20 is periodically cleaned, the openings 64 and 66 in the upper surface 62 of the pan 20 allow the interior area of the pan 20 to be more easily cleaned when articulating the pan 20 into an upside down position. With prior art containers, the intake nozzle, which would typically have been formed with the upper surface of the pan, would have impeded the easy and efficient removal of dust and dirt debris from the interior area of the pan by tending to trap dirt particles therein when the pan was articulated into an upside down position. The present invention thus greatly increases the ease with which the pan of a liquid bath vacuum cleaner system may be periodically cleaned.

Figure 3:
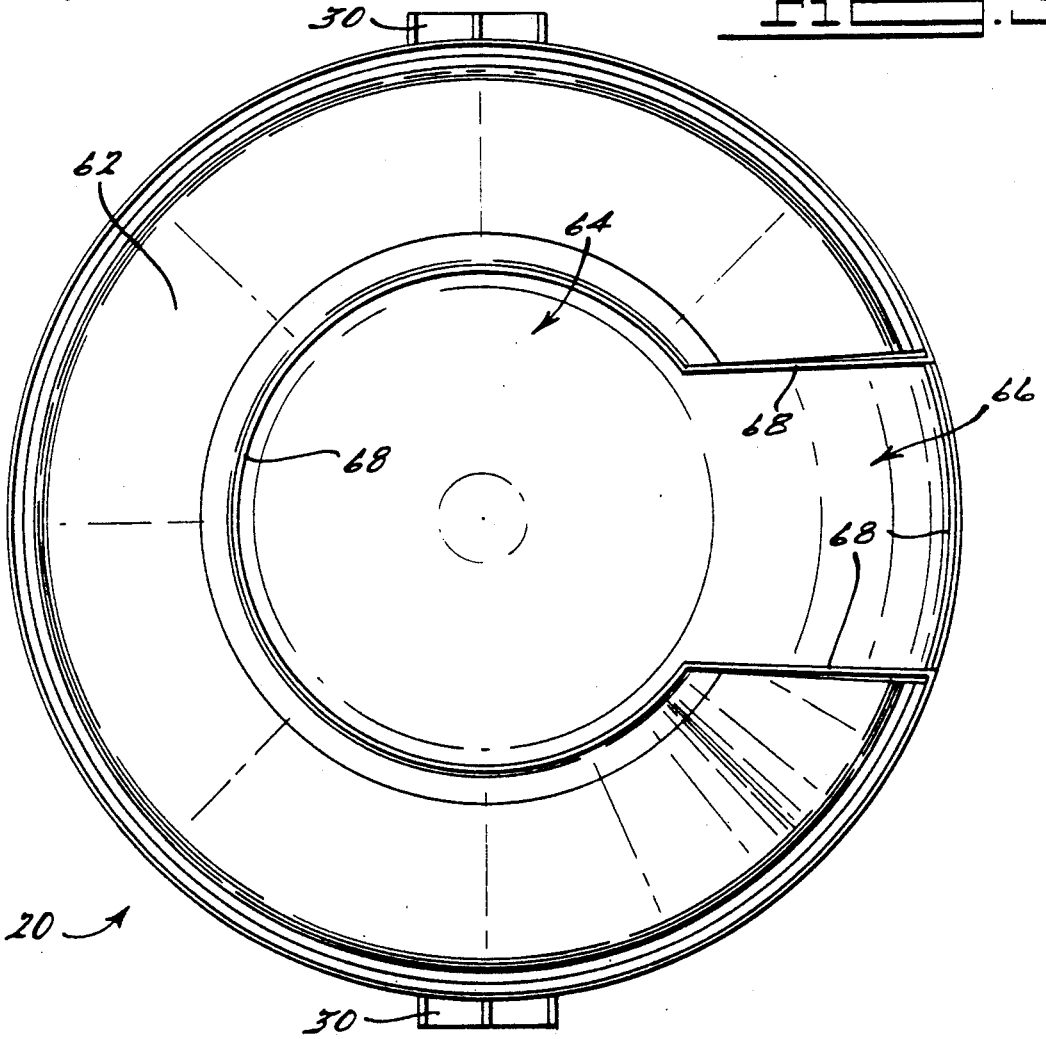
FIG. 3 is a plan view of the liquid pan.

In FIG. 3, the convex upper surface 62 and openings 64 and 66 in the convex upper surface 62 are both shown more clearly. It should be appreciated that the openings 64 and 66 could readily take a variety of shapes, and that the upper surface 62 need not be convex in shape, but could instead take other forms if the lower surface 21 of the main vacuum canister 18 is formed in a complimentary manner. In FIG. 4 the intake nozzle 14 and the downwardly protruding shoulder portion 42 of the lower cover 36 are both shown in more detail together with the gasket 54 which circumscribes them.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A vacuum cleaner system comprising:

a vacuum canister assembly having a lower surface and a side surface;

intake means for ingesting dust and dirt particulate entrained air therethrough, said intake means forming a port within a portion of said vacuum canister assembly, said port defining openings on said side and lower surfaces of said vacuum canister assembly;

said port of said intake means including a lowermost tubular end portion protruding outwardly of said lower surface of said vacuum canister;

pan means for containing a filtering agent in an interior area thereof, said pan means having lower, side and upper surfaces and being removably connected to said lower surface of said vacuum canister assembly, said upper surface of said pan means having an opening operable to receive therethrough a portion of said lowermost tubular end portion of said port, said portion of said lowermost tubular end portion extending to a point near a surface of said filtering agent to thereby enable said dust and dirt entrained air being ingested through said intake means to enter said interior area of said pan means; and wherein said opening facilitates cleaning of said interior area of said pan means when said pan means is detached from said vacuum canister assembly.

2. The system of claim 1, wherein said port of said intake means comprises a tubular intake nozzle integraly formed with said lower and side surfaces of said vacuum canister assembly through which said dust and dirt entrained air may be drawn in.

3. The system of claim 1, wherein said opening in said pan means is operable to receive a portion of said lowermost tubular end portion therethrough.

4. The system of claim 1, wherein said lower surface includes a portion thereof protruding outwardly of said vacuum canister assembly to maintain said dust and dirt entrained ingested air in close proximity to said filtering agent.

5. A vacuum cleaner system comprising:

a vacuum canister assembly having a lower surface and a generally cylindrical side surface;

an intake nozzle integrally formed with said lower and side surfaces of said vacuum canister assembly, said intake nozzle having a lowermost tubular end portion extending outwardly of said lower surface, said intake nozzle further defining an opening in said generally cylindrical side surface of said main vacuum canister assembly to ingest dust and dirt entrained air therethrough;

a removable, generally cylindrical liquid pan having an upper surface operable to be removably coupled to said lower surface of said vacuum canister assembly, said generally cylindrical liquid pan further having an opening in said upper surface for receiving therethrough said lowermost tubular end portion of said intake nozzle, said lowermost tubular end portion extending to a point near a surface of a liquid agent within said generally cylindrical pan; and wherein said opening in said upper surface of said generally cylindrical liquid pan facilitates cleaning of said pan when said pan is removed for cleaning.

6. The system of claim 5, wherein said vacuum canister assembly further includes a separator; and wherein said opening in said upper surface of said generally cylindrical pan is further formed to receive therethrough a portion of said separator.

7. The system of claim 5, further comprising an annular gasket interposed between said lower surface of said vacuum canister assembly and said upper surface of said generally cylindrical liquid pan and circumscribing the perimeter of said lowermost tubular end portion of said intake nozzle.

8. The system of claim 7, wherein said opening includes a raised shoulder portion operable to forcibly abut a portion of said annular gasket which circumscribes said lowermost tubular end portion of said intake nozzle when said generally cylindrical liquid pan is attached to said lower surface of said vacuum canister assembly, thereby forming a relatively air-tight seal between said opening and said lower surface of said vacuum canister assembly.

9. The system of claim 5, wherein said lower surface of said vacuum canister assembly includes a portion protruding downwardly and outwardly of said vacuum canister assembly operable to keep said ingested dust and dirt entrained air in close proximity with a liquid being held by said generally cylindrical liquid pan.

* * * * *